US006926502B2

(12) United States Patent
Lin et al.

(10) Patent No.: US 6,926,502 B2
(45) Date of Patent: Aug. 9, 2005

(54) COMBINATION SHIELD AND CONDUIT BOX COVER

(75) Inventors: Chih M. Lin, Tipp City, OH (US); Norm R. Long, Tipp City, OH (US); William J. Watkins, Tipp City, OH (US); Ron Hirth, Troy, OH (US)

(73) Assignee: A. O. Smith Corporation, Milwaukee, WI (US)

( * ) Notice: Subject to any disclaimer, the term of this patent is extended or adjusted under 35 U.S.C. 154(b) by 166 days.

(21) Appl. No.: 10/080,844

(22) Filed: Feb. 22, 2002

(65) Prior Publication Data

US 2003/0161742 A1 Aug. 28, 2003

(51) Int. Cl.[7] ..... F04B 17/03; H02K 5/00

(52) U.S. Cl. ..... 417/313; 417/410.1; 417/423.14; 310/89

(58) Field of Search ..... 417/410.1, 313, 417/411, 423.9, 423.14, 423.15, 334.7; 415/423.7, 213.1, 214.1, 215.1; 310/89, 71; 74/608, 609; 150/154, 157; 404/25

(56) References Cited

U.S. PATENT DOCUMENTS 3,747,573 A * 7/1973 Foster ..... 123/202
4,521,997 A * 6/1985 Tiberend ..... 52/3
4,631,006 A * 12/1986 Murray ..... 417/234
4,810,169 A 3/1989 Kränzle ..... 417/63
5,012,861 A * 5/1991 Kunze et al. ..... 165/47
5,209,653 A * 5/1993 Murray et al. ..... 417/410.1
5,298,824 A * 3/1994 Franz ..... 310/89
5,311,090 A * 5/1994 Ferlatte ..... 310/88
5,325,739 A * 7/1994 Toyota et al. ..... 74/606 R
5,367,888 A * 11/1994 Muston et al. ..... 62/292
5,378,119 A * 1/1995 Goertzen ..... 417/313
5,391,837 A * 2/1995 Carey ..... 174/50
5,494,417 A 2/1996 Davis et al. ..... 417/423.11
5,531,196 A * 7/1996 Clark ..... 123/195 C
5,647,736 A 7/1997 French ..... 417/423.14
5,714,816 A * 2/1998 Jensen et al. ..... 310/89
5,785,013 A 7/1998 Sinn et al. ..... 123/41.44
6,036,455 A 3/2000 Ciccarelli ..... 417/423.14
6,093,990 A * 7/2000 Meeks et al. ..... 310/91
6,322,326 B1 * 11/2001 Davis et al. ..... 417/40
6,483,213 B1 * 11/2002 Hsu ..... 310/68 R
6,485,257 B1 * 11/2002 Base et al. ..... 415/121.2
6,553,610 B1 * 4/2003 Shideler ..... 15/327.5
6,592,336 B1 * 7/2003 Hirano et al. ..... 417/201
6,664,682 B2 * 12/2003 Williams et al. ..... 310/89

* cited by examiner

*Primary Examiner*—Charles G Freay
(74) *Attorney, Agent, or Firm*—Michael Best & Friedrich, LLP

(57) ABSTRACT

An apparatus comprising a driven element, a driving element operably coupled to the driven element, and a shield coupled to the driving element such that the shield at least partially covers at least one of the driven element and the driving element. The driven element includes a housing with an outer surface. The outer surface has a first raised portion and a first non-raised portion, the first non-raised portion at least partially surrounding the first raised portion, the first raised and first non-raised portions define a first surface pattern. The shield has an outer surface with a second raised portion and a second non-raised portion. The second non-raised portion at least partially surrounds the second raised portion, defining a second surface pattern substantially similar to the first surface pattern.

39 Claims, 2 Drawing Sheets

COMBINATION SHIELD AND CONDUIT BOX COVER

BACKGROUND OF THE INVENTION

The invention relates to a shield for a motor or engine assembly, and more specifically to a combination shield and box cover for a motor or engine assembly.

In certain applications, it is necessary to place a motor-and-pump arrangement outdoors exposing the components to the elements. For example, a motor-pump assembly of an outdoor swimming pool is often located outside. It is desirable to shield or cover the motor to prevent rain from entering the motor housing and/or to prevent the motor from overheating due to exposure to solar radiation.

In addition, a motor of the motor-and-pump arrangement often uses a conduit box, in which one makes connections to the motor. The conduit box will generally have a housing including a cover that closes and partially seals the conduit box, reducing entry of harmful rain or dust. It is desirable to combine the shield with the conduit box cover to reduce the number of components needed to assemble a motor-pump system.

SUMMARY OF THE INVENTION

Accordingly, one embodiment of the invention provides an apparatus comprising a driven element, a driving element operably coupled to the driven element, and a shield coupled to the driving element such that the shield at least partially covers at least one of the driven element and the driving element. The driven element includes a housing with an outer surface. The outer surface has a first raised portion and a first non-raised portion. The first non-raised portion at least partially surrounds the first raised portion, and the first raised and non-raised portions define a first surface pattern. The shield has an outer surface with a second raised portion and a second non-raised portion. The second non-raised portion at least partially surrounds the second raised portion, defining a second surface pattern similar to the first surface pattern.

In another embodiment, the invention provides an apparatus having a pump including a first housing, and a strainer including a second housing. At least one of the first and second housings has a first plurality of indentations that define a first pattern. The apparatus further includes a motor coupled to the pump in a driving relationship, and a conduit box coupled to the motor. The conduit box has a base, at least one wall, and an open side defined by the wall and opposite the base. The apparatus also has a shield including an outer surface. The outer surface includes a second plurality of indentations that define a second pattern. The second pattern is similar to the first pattern. The apparatus further includes at least one fastener coupling the shield to the conduit box such that the shield covers the open side of the conduit box and at least partially covers at least one of the pump and the motor.

In another embodiment, the invention provides an apparatus having a motor, a conduit box coupled to the motor, and a shield coupled to the conduit box. The conduit box has a base, at least one wall, and an open side defined by the wall and opposite the base. The shield is coupled to the conduit box and is sized to cover the open side of the conduit box and at least partially cover the motor. The fastener is the sole attachment between the shield and the conduit box.

Other features and advantages of the invention will become apparent to those skilled in the art upon review of the following detailed description, claims, and drawings.

DETAILED DESCRIPTION

Before any embodiments of the invention are explained, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
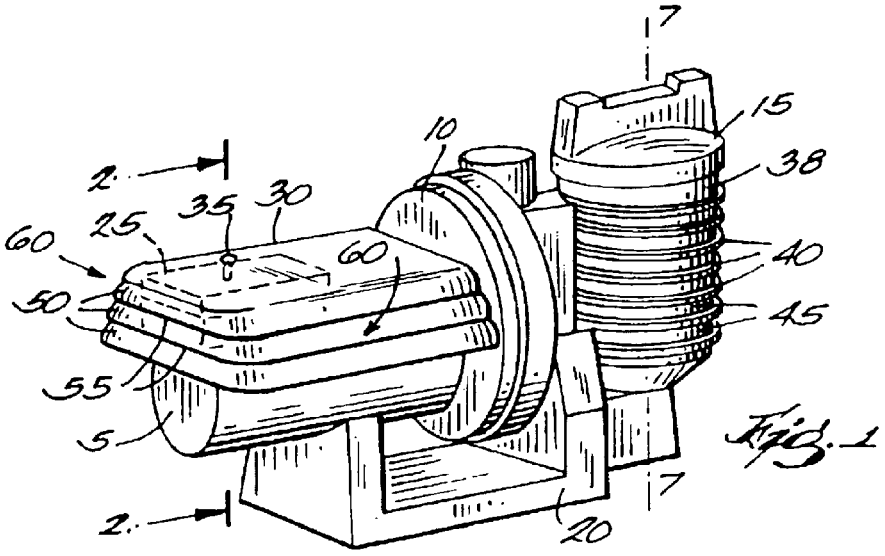
FIG. 1 is a perspective view of a first shield embodying the invention.
Figure 4:
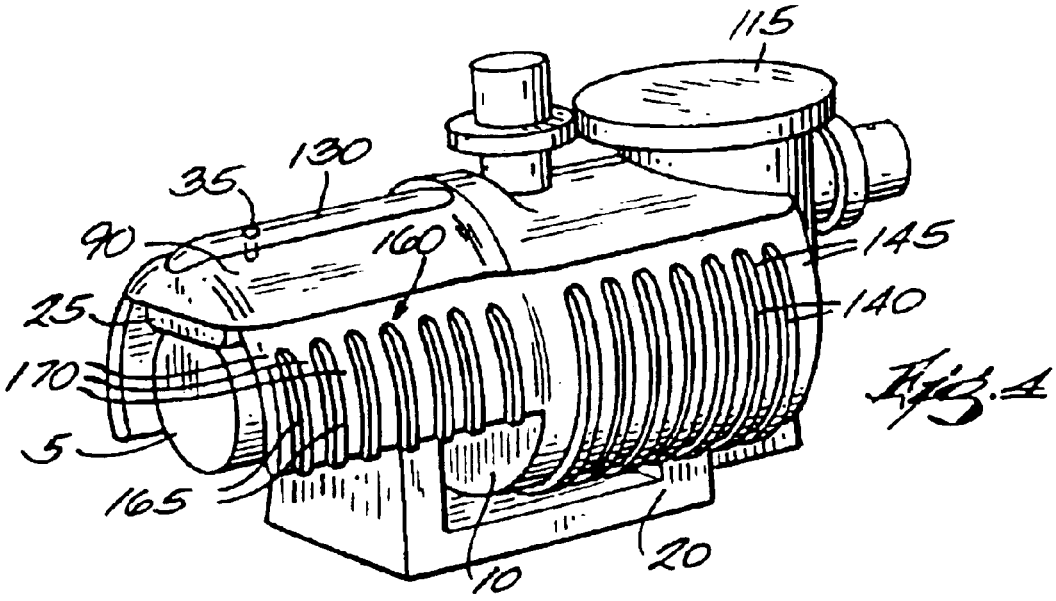
FIG. 4 is a perspective view of a second shield embodying the invention.

FIG. 1 illustrates an apparatus that includes an electric motor 5, a pump 10, a strainer 15, a frame 20, a conduit box 25, and a shield 30. The motor 5 and pump 10 have moving (e.g., rotating) elements coupled to one another allowing the motor 5 to drive the pump 10. The strainer 15, coupled to the pump 10, filters debris out of the fluid before it enters the pump 10. The frame 20 firmly supports the motor-pump-strainer assembly while providing a stable base that can rest on the ground or floor. The conduit box 25, located on top of the motor 5 in the illustrated embodiment, provides a convenient wiring space for connecting the motor 5 to a power supply (not shown). Other embodiments employ a conduit box 25 positioned at a point on the motor 5 other than the top. Attached to the conduit box 25 is the shield 30. The shield 30 covers the conduit box 25, and is large enough to at least partially cover the electric motor 5. In certain embodiments, the shield is large enough to at least partially cover the motor 5 and the pump 10. The shield 30 attaches to the conduit box 25 using the attachment fastener 35, thereby replacing prior conduit box covers. The embodiments shown in FIGS. 1 and 4 illustrate a screw employed as an attachment fastener 35. Other embodiments use other types of fasteners. For example, studs and nuts, bolts, drive screws, and the like function equally well as attachment fasteners.

Referring still to the embodiment of FIG. 1, an outer surface 38 of the strainer 15 comprises a series of concentric rings 40 extending out from the remainder of the outer surface 38. The rings 40 divide the outer surface 38, creating a series of non-raised portions 45 or indentations. The rings 40 have centers located on the central axis 7-7 of the strainer 15 such that the rings 40 are perpendicular to the axis 7-7. The rings 40 are spaced an equal distance apart along the cylindrical body of the strainer 15. The rings 40 and non-raised portions 45 define a surface pattern on the outer surface 38 of the strainer 15. To match this pattern, and give the appearance of a single component rather than an assembly of several components, the shield 30 is manufactured with an outer surface pattern that is similar to that of the strainer 15. The shield 30 illustrated in FIG. 1 uses a series of steps 50 to define a pattern. Each step 50 nests with a former step 50 to define an intersection 55 between adjacent steps 50. The shield 30 uses raised portions, namely the steps 50, partially surrounded by non-raised portions, the intersection 55 of the steps 50, to define a surface pattern that is similar in appearance to the strainer surface pattern. The intersection 55 of adjacent steps 50 form indentations that are substantially parallel to the concentric rings 40 (or non-raised portions 45) of the strainer 15 and spaced apart in a manner substantially similar to the strainer rings 40. The intersections 55 are visible and continuous on the exposed outer side surfaces 60 of the shield 30.

Figure 2:
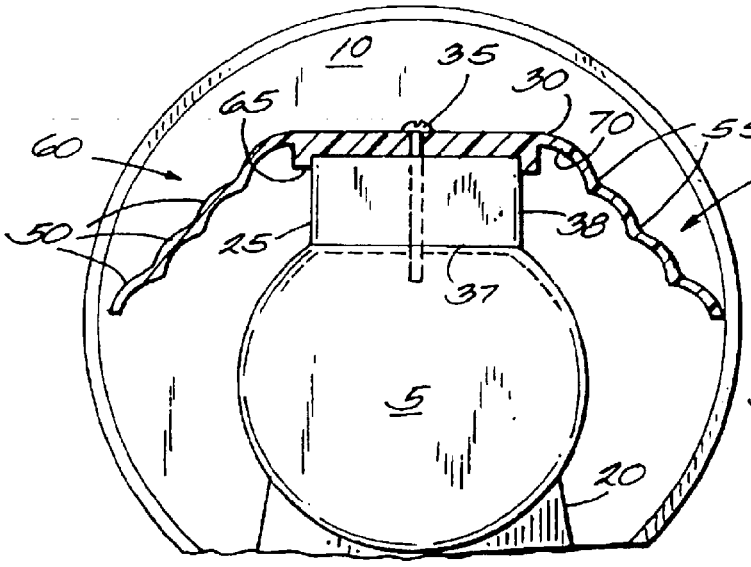
FIG. 2 is a section view of the shield illustrated in FIG. 1.
Figure 3:
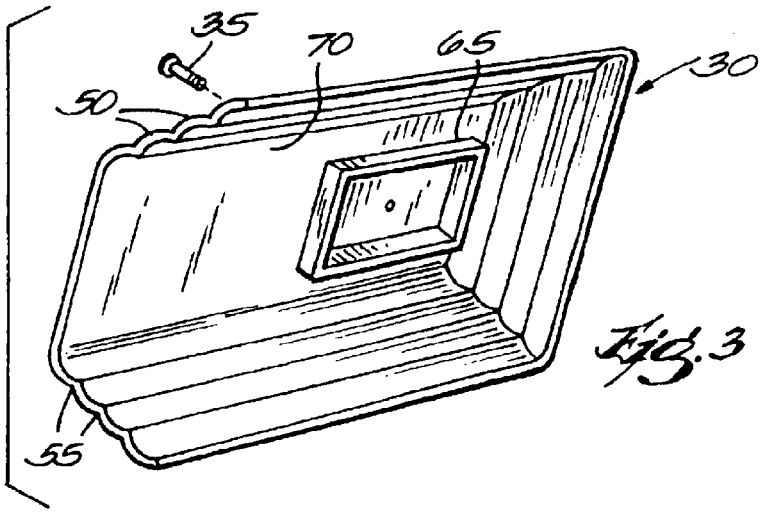
FIG. 3 is a perspective view of the inside of the shield illustrated in FIG. 1.

FIG. 2 shows the apparatus of FIG. 1 sectioned through line 2-2, and further illustrates the attachment of the shield 30 to the conduit box 25. The shield 30 is positioned to cover the open portion of the conduit box 25 in much the same manner as the original conduit box cover. A single fastener 35 secures the shield 30 to the conduit box 25. In some embodiments, the shield 30 is capable of retrofitting to an existing conduit box with fastener 35. The conduit box base 37, at least one side wall 38, and shield 30 thus completely define the wiring space. FIG. 2 illustrates a conduit box 25 that uses a single fastener 35 for attachment of the cover. Other conduit boxes 25 are available that use more than one fastener 35 to attach the cover to the box 25. The shield 30 functions equally well when attaching to a conduit box having multiple cover attachment points. In addition, FIGS. 1–3 illustrate a rectangular conduit box 25. Other shape conduit boxes function equally well with the invention. For example, octagonal or round boxes are contemplated by the invention. In still other embodiments, the shield connects directly to the motor housing or other support structure and no conduit box is used.

In some embodiments, the shield 30 includes a lip 65 (FIGS. 2 and 3) on internal surface 70. The lip 65 facilitates proper alignment of the shield 30 relative to the motor 5. The lip size, shape, and position allow the lip 65 to engage the conduit box 25, and align the shield 30 in the desired position, assuring proper assembly. The lip 65 illustrated in FIG. 3 is larger than the conduit box 25 and completely surrounds the outside of the box 25. In other embodiments, the lip 65 is smaller than the box 25 allowing it to fit snuggly within the box 25. In even other embodiments, rather than a continuous lip 65 surrounding the box 25, several small bosses, in conjunction with the attaching fastener 35, are used to positively locate the shield 30. It may also be desirable to provide a soft material on or near the lip 65 that contacts the conduit box 25 and provides for a better seal between the shield 30 and the conduit box 25.

Turning to FIG. 4, the apparatus includes an electric motor 5, a pump 10, a strainer 115, a frame 20, a conduit box 25, and a shield 130. Like the embodiment of FIG. 1, the motor 5 and pump 10 include moving elements coupled to one another such that the motor 5 drives the pump 10. In addition, the strainer 115, coupled to the pump 10, filters debris that would otherwise enter the pump 10. Also, the present embodiment includes a conduit box 25 coupled to the motor 5 and a shield 130 coupled to the conduit box 25. The strainer 115 of FIG. 4 illustrates a second possible outer surface pattern. A series of vertical raised portions or ridges 140 are spaced an equal distance apart. The vertical ridges 140 rise above, and are at least partially surrounded by, the non-raised adjacent surfaces 145 to define a surface pattern. The shield 130 outer surface 160 employs similar ridges 165, rising above the adjacent areas 170 to define a surface pattern substantially similar to that of the strainer 115. The shield 130 attaches to the conduit box 25 in a manner similar to that described with regards to the embodiment of FIG. 1. While only some embodiments of the surface pattern have been described, many others are possible and within the scope of the invention. For example, indentations may be used in place of ridges 140 and 145.

It is generally desirable to manufacture the shield 30 in a single operation to minimize its cost. Therefore, a preferred embodiment uses an injection molded polycarbonate plastic material. Other embodiments may employ multiple pieces attached using any common attachment means (e.g., glue or other adhesives, soldering, brazing, welding, or fasteners) to make a single shield 30. Like the method of manufacture, the material used is not critical to the function of the invention. For example, other embodiments use drawn sheet metal or formed aluminum, rather than injection molded plastic, to manufacture a shield 30.

While an electric motor 5 has been illustrated in FIGS. 1 and 4, other driving elements will function as well with the invention. For example, an internal combustion engine could be used to drive a pump 10 or other device. The shield would attach to a conduit box 25 or other member and at least partially cover the engine protecting it from the elements.

FIGS. 1 and 4 show a pump 10 as the driven element, however, like the motor 5 there are many other components that can be driven while still functioning with the invention. For example, an air compressor could be the driven element. The strainer 15 would still be employed to filter the air before the air enters the compressor.

Thus, the invention provides, among other things, a new and useful shield for a motor or engine assembly. Various features of the invention are set forth in the following claims.

What is claimed is:

1. An apparatus comprising:

a driven element including a first housing;

a strainer coupled to the driven element and including a second housing having an outer surface, the outer surface having a first raised portion and a first non-raised portion, the first non-raised portion at least partially surrounding the first raised portion, the first raised and first non-raised portions defining a first surface pattern;

a driving element operably coupled to the driven element; and a shield coupled to the driving element such that the shield at least partially covers at least one of the driven element and the driving element, the shield having an outer surface, the outer surface having a second raised portion and a second non-raised portion, the second non-raised portion at least partially surrounding the second raised portion, the second raised and second non-raised portions defining a second surface pattern substantially similar to the first surface pattern.

2. An apparatus comprising:

a driven element including a first housing;

an air filter coupled to the driven element and including a second housing having a first raised portion and a first non-raised portion, the first non-raised portion at least partially surrounding the first raised portion, the first raised and first non-raised portions defining a first surface pattern;

a driving element operably coupled to the driven element; and a shield coupled to the driving element such that the shield at least partially covers at least one of the driven element and the driving element, the shield having an outer surface, the outer surface having a second raised portion and a second non-raised portion, the second non-raised portion at least partially surrounding the second raised portion, the second raised and second non-raised portions defining a second surface pattern substantially similar to the first surface pattern.

3. An apparatus comprising:

a driven element including a housing having an outer surface, the outer surface having a first raised portion and a first non-raised portion, the first non-raised portion at least partially surrounding the first raised portion, the first raised and first non-raised portions defining a first surface pattern;

a driving element operably coupled to the driven element; and a shield coupled to the driving element such that the shield at least partially covers at least one of the driven element and the driving element, the shield having an outer surface, the outer surface having a second raised portion and a second non-raised portion, the second non-raised portion at least partially surrounding the second raised portion, the second raised and second non-raised portions defining a second surface pattern substantially similar to the first surface pattern;

wherein the apparatus further comprises a conduit box coupled to the driving element, the conduit box having a base, and at least one wall, the base and wall partially defining a space, the space having an open side opposite the base, and wherein the shield is coupled to the conduit box, and wherein the conduit box base, at least one wall, and the shield fully define and surround the space.

4. An apparatus as set forth in claim 3 wherein the driven element is a pump.

5. An apparatus as set forth in claim 3 wherein the driving element is an electric motor.

6. An apparatus as set forth in claim 3 wherein the apparatus further includes an alignment member coupled to the shield, and wherein the alignment member engages the conduit box to properly align the shield and the driving member.

7. An apparatus as set forth in claim 6 wherein the alignment member is integrally formed with the shield.

8. An apparatus as set forth in claim 6 wherein the alignment member is a continuous lip sized and shaped to surround the conduit box.

9. An apparatus comprising:

a driven element including a housing having an outer surface, the outer surface having a first raised portion and a first non-raised portion, the first non-raised portion at least partially surrounding the first raised portion, the first raised and first non-raised portions defining a first surface pattern;

a driving element operably coupled to the driven element;

at least one fastener; and a shield coupled to the driving element such that the shield at least partially covers at least one of the driven element and the driving element, the shield having an outer surface, the outer surface having a second raised portion and a second non-raised portion, the second non-raised portion at least partially surrounding the second raised portion, the second raised and second non-raised portions defining a second surface pattern substantially similar to the first surface pattern;

wherein the apparatus further comprises a conduit box coupled to the driving element, the conduit box having a base, and at least one wall, the base and wall partially defining a space, the space having an open side opposite the base, and wherein the shield is coupled to the conduit box, and wherein the at least one fastener couples the shield to the conduit box.

10. An apparatus as set forth in claim 9 wherein the conduit box base, at least one wall, and the shield fully define and surround the space.

11. An apparatus as set forth in claim 9 wherein the at least one fastener is a screw.

12. An apparatus as set forth in claim 9 wherein the at least one fastener is a single screw that directly connects the shield to the conduit box.

13. An apparatus comprising:

a pump including a first housing;

a strainer including a second housing, at least one of the first and second housings having a first plurality of indentations that define a first pattern;

a motor coupled to the pump in a driving relationship;

a conduit box coupled to the motor, the conduit box having a base, at least one wall, and an open side defined by the wall and opposite the base;

a shield including an outer surface, the outer surface having a second plurality of indentations that define a second pattern, the second pattern being similar to the first pattern; and at least one fastener coupling the shield to the conduit box such that the shield covers the open side of the conduit box and at least partially covers at least one of the pump and the motor.

14. An apparatus as set forth in claim 13 wherein the first plurality of indentations are substantially parallel to one another, and wherein the second plurality of indentations are substantially parallel to one another.

15. An apparatus as set forth in claim 14 wherein the first plurality of indentations is parallel to the second plurality of indentations.

16. An apparatus as set forth in claim 13 wherein the at least one fastener is a single screw.

17. An apparatus as set forth in claim 13 wherein the open side faces up when the motor is in a driving position.

18. An apparatus as set forth in claim 16 wherein the single screw directly connects the shield to the conduit box.

19. An apparatus as set forth in claim 13 wherein the apparatus further comprises an alignment member coupled to the shield, and wherein the alignment member engages the conduit box to properly align the shield and the motor.

20. An apparatus as set forth in claim 19 wherein the alignment member is integrally formed with the shield.

21. An apparatus as set forth in claim 19 wherein the alignment member is a continuous lip sized and shaped to surround the conduit box.

22. An apparatus comprising:

a pump including a first housing;

a strainer coupled to the pump, the strainer including a second housing, at least one of the first and second housings having a first raised portion and a first non-raised portion, the first non-raised portion at least partially surrounding the first raised portion, the first raised portion and first non-raised portion defining a first surface pattern;

a motor operatively coupled to the pump;

a conduit box coupled to the motor, the conduit box having a base, at least one wall, and an open side defined by the wall and opposite the base;

a shield including an outer surface, the outer surface having a second raised portion and a second non-raised portion, the second non-raised portion at least partially surrounding the second raised portion, the second raised and second non-raised portions defining a second surface pattern; and at least one fastener coupling the shield to the motor such that the shield at least partially covers at least one of the pump and the motor.

23. An apparatus as set forth in claim 22 wherein the apparatus further includes an alignment member coupled to the shield, and wherein the alignment member engages the conduit box to properly align the shield and the motor.

24. An apparatus as set forth in claim 23 wherein the alignment member is integrally formed with the shield.

25. An apparatus as set forth in claim 23 wherein the alignment member is a continuous lip sized and shaped to surround the conduit box.

26. An apparatus as set forth in claim 22 wherein the open side faces up when the motor is in an operating position.

27. An apparatus as set forth in claim 22 wherein the at least one fastener is a single screw that directly connects the shield to the conduit box.

28. An apparatus as set forth in claim 22 wherein the shield covers the open side of the conduit box.

29. An apparatus comprising:

a motor;

a conduit box coupled to the motor, the conduit box having a base, at least one wall, and an open side defined by the wall and opposite the base;

a shield coupled to the conduit box, the shield being substantially larger than the conduit box such that the shield covers the open side of the conduit box and at least a portion of the motor not covered by the conduit box; and an alignment member coupled to the shield, wherein the alignment member engages the conduit box to properly align the shield and the motor.

30. An apparatus as set forth in claim 29 wherein the alignment member is integrally formed with the shield.

31. An apparatus as set forth in claim 29 wherein the alignment member is a continuous lip sized and shaped to surround the conduit box.

32. An apparatus as set forth in claim 29 further comprising a fastener, the fastener being the sole attachment between the shield and the conduit box.

33. An apparatus comprising:

a motor;

a conduit box coupled to the motor, the conduit box having a base, at least one wall, and an open side defined by the wall and opposite the base, wherein the open side faces up when the motor is in an operating position; and a shield coupled to the conduit box and sized to cover the open side of the conduit box and to substantially cover the motor.

34. An apparatus as set forth in claim 33 wherein the apparatus further includes an alignment member coupled to the shield, and wherein the alignment member engages the conduit box to properly align the shield and the motor.

35. An apparatus as set forth in claim 34 wherein the alignment member is integrally formed with the shield.

36. An apparatus as set forth in claim 34 wherein the alignment member is a continuous lip sized and shaped to surround the conduit box.

37. An apparatus as set forth in claim 33 further comprising a fastener, the fastener being the sole attachment between the shield and the conduit box.

38. An apparatus comprising:

a driven element including a housing having an outer surface, the outer surface having a first raised portion and a first non-raised portion, the first non-raised portion at least partially surrounding the first raised portion, the first raised and first non-raised portions defining a first surface pattern;

a driving element operably coupled to the driven element; and a shield coupled to the driving element such that the shield at least partially covers at least one of the driven element and the driving element, the shield having an outer surface, the outer surface having a second raised portion and a second non-raised portion, the second non-raised portion at least partially surrounding the second raised portion, the second raised and second non-raised portions defining a second surface Pattern substantially similar to the first surface pattern;

wherein the apparatus further comprises a conduit box coupled to the driving element, the conduit box having a base, and at least one eall, the base and wall partially defining a space, the space having an open side opposite the base, and wherein the shield is coupled to the conduit box, and wherein the shield covers the open side faces up when the driving element is in an operating position.

39. An apparatus compising:

a driven element inluding a housing having an outer suface, the outer surface having a first raised portion and a first non-raised portion, the first non-raised portion at least partially surrounding the first raised portion, the first raised and first non-raised portion defining a first surface pattern;

a driving element operably coupled to the driven element; and a shield coupled to the driving element such that the shield at least partially covers at least one of the driven element and the driving element, the shisld having an outer surface, the outer surface having a second raised portion and a second non-raised portion, the second non-raised portion at least partially surrounding the second raised portion, the second raised and second non-raised portions defining a second surface pattern substantially similar to the first surface pattern;

wherein the apparatus further comprises a conduit box coupled to the driving element, the conduit box having a base, and at least one wall, the base and wall partially defining a space, the space having an open side opposite the base, and wherein the shield is coupled to the conduit box, and wherein the shield covers the open side of the conduit box.

* * * * *